US011274404B2

(12) United States Patent
Thiesse et al.

(10) Patent No.: US 11,274,404 B2
(45) Date of Patent: Mar. 15, 2022

(54) RETENTION APPARATUS FOR SCREED COVER

(71) Applicant: Caterpillar Paving Products Inc., Brooklyn Park, MN (US)

(72) Inventors: Ryan T. Thiesse, Otsego, MN (US); Zachary R. Bleakly, White Bear Lake, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 268 days.

(21) Appl. No.: 16/351,897

(22) Filed: Mar. 13, 2019

(65) Prior Publication Data

US 2020/0291585 A1 Sep. 17, 2020

(51) Int. Cl.

| | |
|---|---|
| ***E01C 19/22*** | (2006.01) |
| ***E01C 19/42*** | (2006.01) |
| ***E01C 19/48*** | (2006.01) |

(52) U.S. Cl.

CPC ..... *E01C 19/42* (2013.01); *E01C 19/4873* (2013.01); *E01C 2301/10* (2013.01)

(58) Field of Classification Search

None

See application file for complete search history.

(56) References Cited

U.S. PATENT DOCUMENTS 1,996,153 A * 4/1935 Heltzel ..... E01C 23/04 404/87
2,589,256 A * 3/1952 Horning ..... E01C 19/4873 404/83
2,951,426 A * 9/1960 Pollitz ..... E01C 19/4853 404/95
3,557,672 A * 1/1971 Shurtz ..... E01C 19/4873 404/95
4,507,015 A * 3/1985 Furukawa ..... E01C 13/065 404/101

(Continued)

FOREIGN PATENT DOCUMENTS

| | | |
|---|---|---|
| DE | 9211854 | 4/1994 |
| EP | 1767698 | 3/2007 |

(Continued)

*Primary Examiner* — Thomas B Will
*Assistant Examiner* — Katherine J Chu
(74) *Attorney, Agent, or Firm* — Schwegman, Lundberg & Woessner; Jeff A. Greene

(57) ABSTRACT

A screed assembly for use with a paving machine is disclosed. The screed assembly can optionally comprise: a screed plate; a heating assembly having a heating element positioned on the screed plate; a heating element cover positioned on or adjacent the heating element; a screed frame releasably coupled to the screed plate and having one or more openings therein; and a plurality of compression spring assemblies connected to the screed frame and connected to the heating element cover. Each of the plurality of compression spring assemblies can be are configured to exert a desired force on the heating element cover. The plurality of compression spring assemblies are accessible through the one or more openings of the screed frame and the bolt is moveable relative to the screed frame to adjust a position of the heating element cover relative to the heating element for facilitating removal of the heating element.

16 Claims, 4 Drawing Sheets

(56) References Cited

U.S. PATENT DOCUMENTS

| | | | | |
|---|---|---|---|---|
| 6,318,928 | B1 * | 11/2001 | Swearingen | E01C 19/42 404/72 |
| 8,517,630 | B2 * | 8/2013 | Graham | E01C 19/48 404/118 |
| 9,885,158 | B2 * | 2/2018 | Grimm | E01C 19/48 |
| 10,017,905 | B2 | 7/2018 | Young, Jr. | |
| 11,028,540 | B2 * | 6/2021 | Haven | E01C 19/4866 |
| 2020/0095737 | A1 * | 3/2020 | Haven | E01C 19/48 |

FOREIGN PATENT DOCUMENTS

| | | | | |
|---|---|---|---|---|
| FR | 989584 | A * | 9/1951 | E01C 19/4873 |
| GB | 1240032 | A * | 7/1971 | E01C 19/40 |
| GB | 1367615 | A * | 9/1974 | E01C 19/486 |
| WO | 2018136049 | | 7/2018 | |

* cited by examiner

RETENTION APPARATUS FOR SCREED COVER

TECHNICAL FIELD

The present application relates generally to apparatuses, methods and systems that retain a heating element cover and enable the ease of replacement and installation of screed heating elements positioned under the heating element cover in working machines.

BACKGROUND

Pavers or paving machines are working machines used in an asphalt paving process to create a new road surface. Such pavers assist in pouring and spreading paving material to form a new roadway surface or mat. With asphalt pavers, an aggregate filled bituminous mixture that comprises the paving material is spread while hot and is then compacted so that a hardened pavement surface is formed upon cooling. Pavers typically utilize a heavy assembly termed a "screed" that is drawn behind the paving machine. The screed assembly includes a replaceable screed plate to spread a smooth even layer of paving material on the prepared roadbed. The weight and/or a vibration of the screed assembly aids in compressing the paving material and performing initial compaction of the paving material layer.

To facilitate laying of the paving material, the screed plate is typically heated, to a temperature in the range of about 82° to 171° C. (180° to 340° F.). Heating the screed plate assists the paving material in flowing under the screed plate and reduces adhesion of the paving material to the screed plate. If the screed plate is not adequately heated, the bituminous mixture contacting the bottom of the screed plate begins to harden, resulting in buildup of paving material and excessive drag.

Some screeds such as those of U.S. Pat. No. 10,017,905 utilize a compression bolt assembly. However, the compression bolt assembly as disclosed in U.S. Pat. No. 10,017,905 is configured to be inserted through and upper portion of the screed plate and through a hole in a primary bolt. The compression bolt assembly cooperates with the upper portion of the screed plate to apply a desired compression force via direct contact to the heating element on a lower screed plate. The compression bolt assembly of U.S. Pat. No. 10,017,905 fails to contemplate (and therefore address) ease of replacement and installation of screed heating elements and/or the promotion of even heat distribution. For example, the arrangement of U.S. Pat. No. 10,017,905 contemplates the use of the upper portion of the screed plate and the compression bolt assembly with multiple components of the compression bolt assembly inaccessible or difficult to reach under the upper portion of the screed plate. Furthermore, the compression bolt assembly must be removed for the upper portion of the screed plate to be removed to access the screed heating elements.

SUMMARY OF THE INVENTION

In one example, a screed assembly for use with a paving machine is disclosed. The screed assembly can optionally comprise: a screed plate; a heating assembly having a heating element positioned on the screed plate; a heating element cover positioned on or adjacent the heating element; a screed frame releasably coupled to the screed plate and having one or more openings therein; and a plurality of compression spring assemblies connected to the screed frame and connected to the heating element cover, wherein each of the plurality of compression spring assemblies includes at least a bolt, a spring and a spring adjustment nut that together are configured to exert a desired force on the heating element cover, wherein the plurality of compression spring assemblies are accessible through the one or more openings of the screed frame and the bolt is moveable relative to the screed frame to adjust a position of the heating element cover relative to the heating element for facilitating removal of the heating element In another example, a method of assembling a screed assembly for use with a paving machine is disclosed. The method can optionally include positioning a heating element between a screed plate and a heating element cover; connecting at least the screed plate to a screed frame of the screed assembly; connecting the heating element cover to the screed frame with a plurality of compression spring assemblies; and setting a desired force exerted on the heating element cover by the plurality of compression spring assemblies.

In another example, a paving system for laying an asphalt paving material is disclosed. The system can optionally include a paving machine; and a screed assembly configured to be removably connected to the paving machine. The screed assembly can optionally comprise: a screed plate; a heating element cover; a heating assembly including a heating element insertable between the screed plate and the heating element cover; a screed frame configured to be spaced from the screed plate and removably coupled thereto, wherein the screed frame includes one or more openings therein; and a plurality of compression spring assemblies configured to be connected to the screed frame and configured to be connected to the heating element cover, wherein the plurality of compression spring assemblies are configured to set a desired position between the heating element cover and the heating element, and wherein the plurality of compression spring assemblies reside in a space in the screed frame and are accessible through the one or more openings of the screed frame to adjust the desired position.

DETAILED DESCRIPTION

Figure 1:
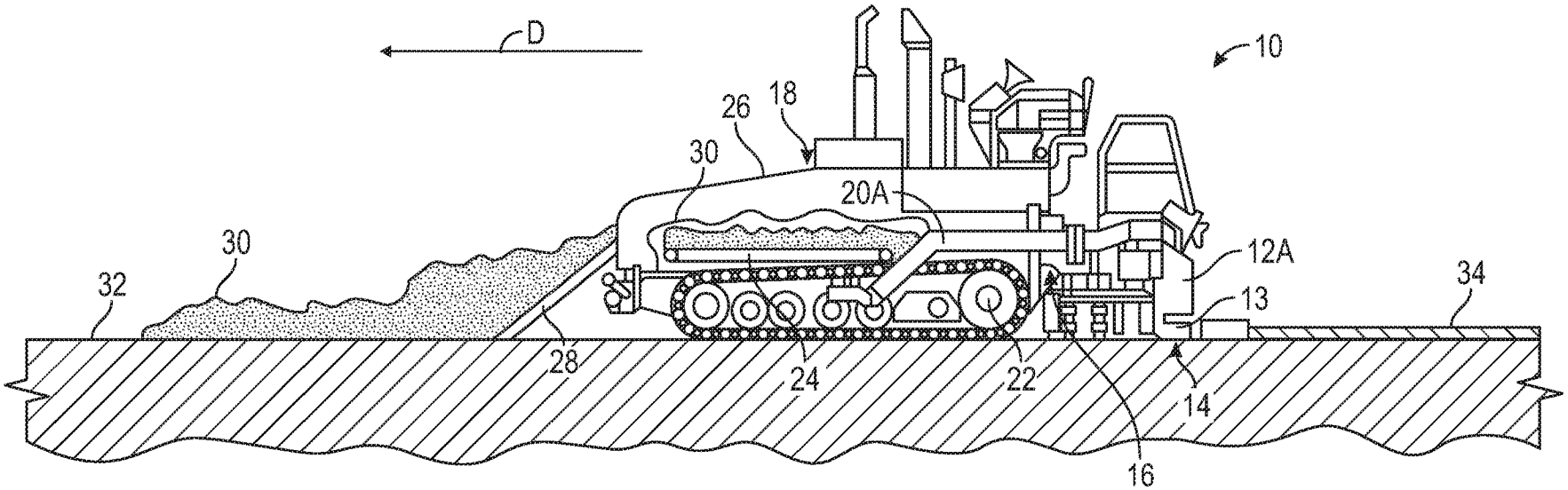
FIG. 1 is a schematic side view of an asphalt paving machine showing a screed assembly according to an example of the present application.

FIG. 1 is a schematic side view of an asphalt paving machine 10 showing a screed side plate 12A of a screed assembly 14 positioned rearward of an auger system 16. The asphalt paving machine 10 can comprise a vehicle portion 18, which can be connected to the screed assembly 14 via a tow arm 20A. The paving machine 10 can additionally a second side plate (not shown) and a screed plate 13. A second tow arm (not shown) can also be provided in some cases. The vehicle portion 18 can additionally comprise a propulsion element 22, a conveyor system 24, a hopper 26 and an elevator 28.

Loose paving material 30 can be deposited onto a work surface 32 via a dump truck or other suitable means. The paving machine 10 can include means for moving the loose paving material 30 into the hopper 26, such as the elevator 28. The paving material 30 can be asphalt, aggregate materials or concrete. In various embodiments, the paving material 30 can be deposited directly into the hopper 26 of the paving machine 10. The paving machine 10 can travel in direction D, while the conveyor system 24 can move paving material in the opposite direction from the hopper 26 to the auger system 16. Various methods and machines such as a dump truck, material transfer vehicle, etc. can be employed to get the paving material 30 into the hopper 26.

The conveyor system 24 can be disposed within or below the hopper 26. The conveyor 26 can transport the loose paving material 30 through the vehicle portion 18 toward the auger system 16. A grading implement, such as the screed assembly 14, can be attached to the rear of the vehicle portion 18 to receive the paving material 30 from the auger system 16, The screed assembly 14 can be towed by tow arms 20A, only one of which is shown in FIG. 1. The propulsion system 22 can comprise a ground engaging element, such as an endless track as shown in FIG. 1, wheels or the like for propelling the paving machine 10 along the work surface 32. The loose paving material 30 can be deposited by the conveyor system 24 in front of the auger system 16. The auger system 16 can disperse the loose paving material 30 along the width (into the plane of FIG. 1) of the screed assembly 14. The screed assembly 14 can compact the loose paving material 30 into a mat 34 behind the paving machine 10.

More particularly, in order to facilitate formation of the mat 34, the paving machine 10 can be outfitted with the screed plate 13. The screed plate 13 can be configured to spread a smooth even layer of the paving material on the prepared roadbed as the mat 34. The weight and/or a vibration of the screed assembly 14 aids in compressing the paving material and performing initial compaction of the paving material layer into the mat 34. To facilitate laying of the paving material 30 as the mat 34, the screed plate 13 can be heated to a temperature in the range of about 82° to 171° C. (180° to 340° F.). Heating the screed plate 13 can assist the paving material 30 in flowing under the screed plate 13 and can reduce adhesion of the paving material 30 to the screed plate 13.

Figure 2:
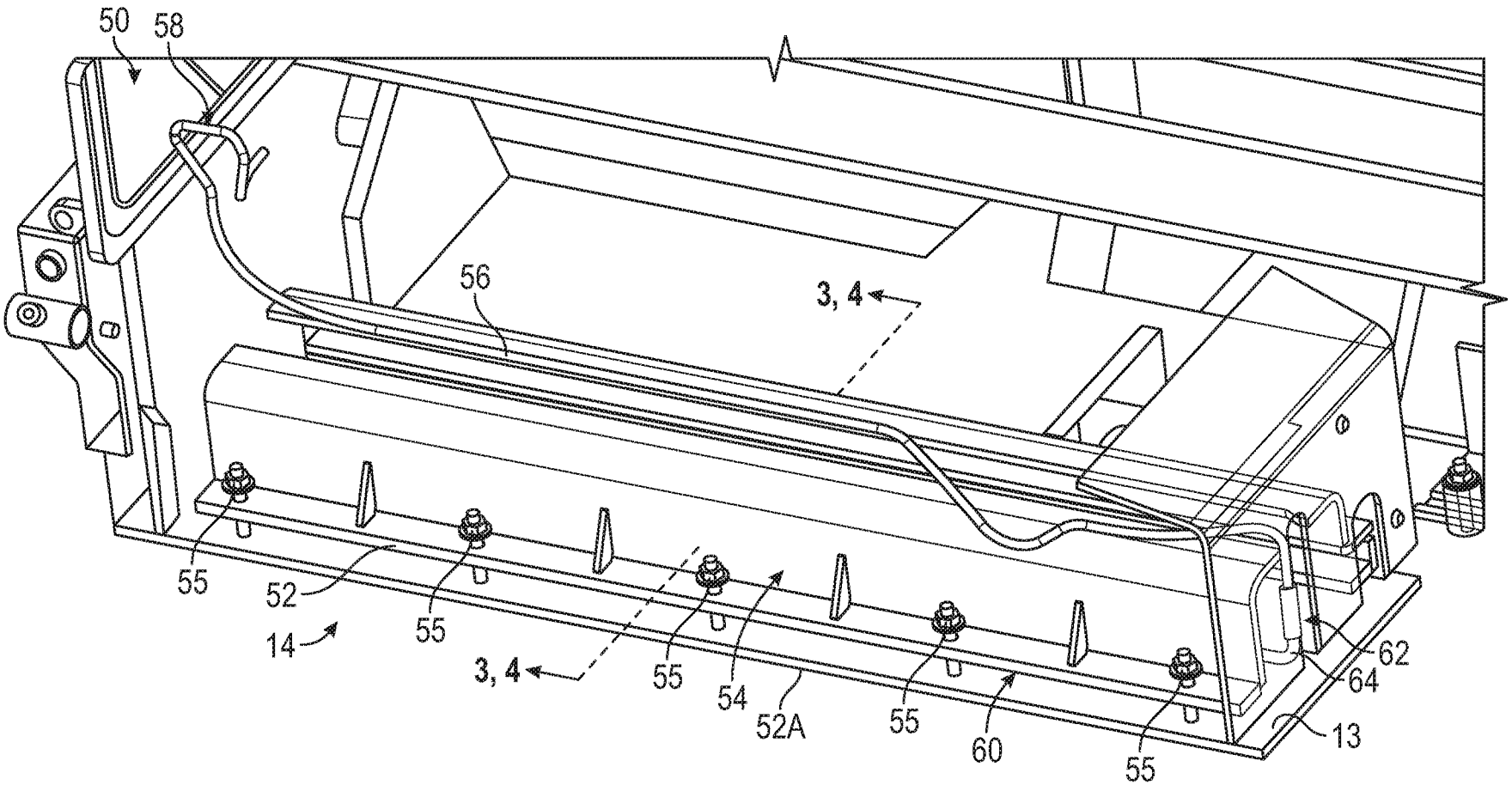
FIG. 2 is a rear perspective view of the screed assembly further illustrating a screed frame, a screed plate, a heating element cover and a heating assembly according to an example of the present application.

FIG. 2 shows a portion 50 of a screed assembly 14 from the rear. The screed assembly 14 can typically be separated into several separate portions positioned at different positions relative to a cross-directional width of the paving machine 10 (FIG. 1). Only the single portion 50 is shown in FIG. 2 with the understanding that each portion (or section) will have a separate screed plate, screed frame, heating assembly, heating element cover etc. that can be constructed in the manner described herein. Separating the screed assembly 14 in this manner can allow for ease of access and removal of components for, installation, maintenance and other purposes. Thus, it is contemplated that the screed assembly 14 can be any of a number of configurations such as a fixed width screed or a multiple section screed that includes extensions.

FIG. 2 shows a trailing or rear side 52 of the screed assembly 14 including a trailing edge 52A of the screed plate 13. A screed frame 54 of the screed assembly 14 physically connects components such as the screed plate 13 back to the screed side plate 12A. In the case of the screed plate 13, such physical connection to the screed frame 54 can be via a number of fasteners 55 such as bolts and nuts, some of which are illustrated in FIG. 2. As previously discussed, the screed assembly 14 can be connected back to the paving machine 10 via one or more tow arms (not shown in FIG. 2 but illustrated in FIG. 1) or another means.

A cable 56 of a heating assembly 58 passes through the screed frame 54. The cable 56 can extend to physically and electrically connect with a physical and electrical connection of the paving machine 10. The heating assembly 58 passes through the screed frame 54 to a location where a heating element (not shown in FIG. 2) can be positioned between a heating element cover 60 and the screed plate 13 as will be illustrated and discussed subsequently. In this location, the heating element of the heating assembly 58 can heat the screed plate 13 to a temperature range as desired as discussed above. The heating element cover 60 will be further discussed subsequently and can be configured to have a small gap from or in some cases abut the heating assembly 58. The size of this gap can be changed to facilitate removal of the heating assembly 58. The heating element cover 60 can be designed to protect the heating element from loose paving material and other objects that may enter a space between the screed frame 54 and the screed plate 13.

The screed frame 54 can have an access port 62 along a side 64 thereof. The access port 62 allows for withdrawal of the heating assembly 58 including the heating element from the side 64 for repair or replacement of the heating assembly 58. The access port 62 can also facilitate installation of a replacement heating element as needed. The removal of the heating element from the screed assembly 14 is further detailed below.

The screed plate 13 and heating element cover 60 can be constructed of appropriate material(s) such as high wear steel or other metal. Although shown as a substantially flat thin plate in the examples of FIGS. 2-4, the heating element cover 60 can have various features such as walls, flanges, channels, etc. that can facilitate capture, retention, etc. of various components such as the heating element and/or can deter loose paving material from entering below the heating element cover 60 and being positioned adjacent the heating element. The contour of the screed plate 13 can determine the quality, evenness and smoothness of the paving material that is being laid down. As such, the screed plate 13 (and heating element cover 60) can be flexed under tensile loads during use to achieve desired crowning or other surface contours. If a substantially flat surface is desired for the mat, it is desirable to avoid heat concentrations or load concentrations, which can cause the screed plate 13 to warp and otherwise became non-substantially flat along a major bottom surface.

The heating assembly 58 can be configured to heat the screed plate 13 and can be connected to a power supply such as an electric generator. A greater number heating assemblies can be provided for each screed plate 13 then are shown, for example, in FIGS. 2 and 4. The length and number of such heater assemblies 58 can vary depending on various factors including the length the screed plate 13.

Figure 3:
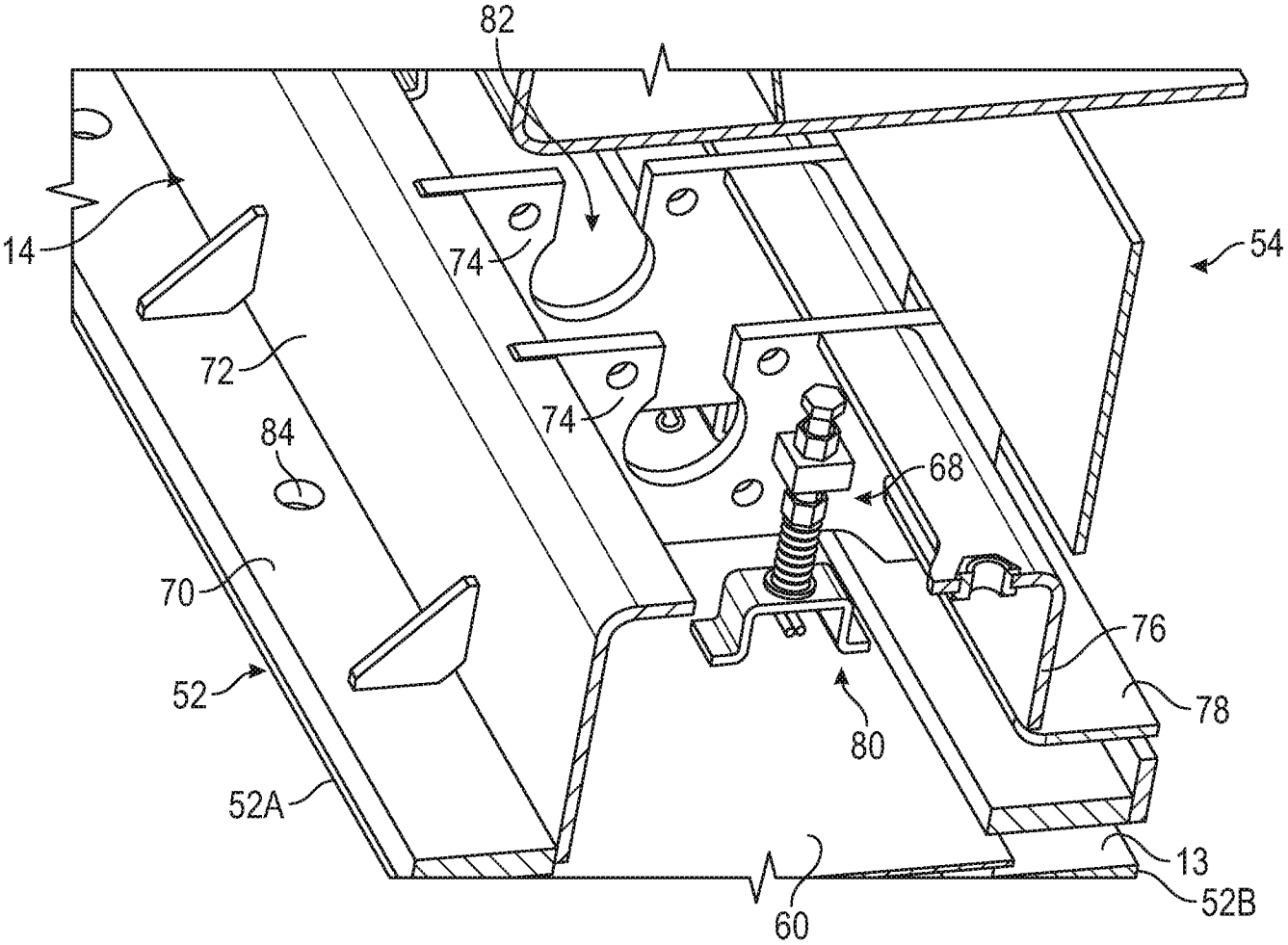
FIG. 3 is a perspective view of a cross-section of the screed assembly of FIG. 2 showing one of a plurality of compression bolt assemblies that couple the heating element cover to the screed frame according to an example of the present application.
Figure 4:
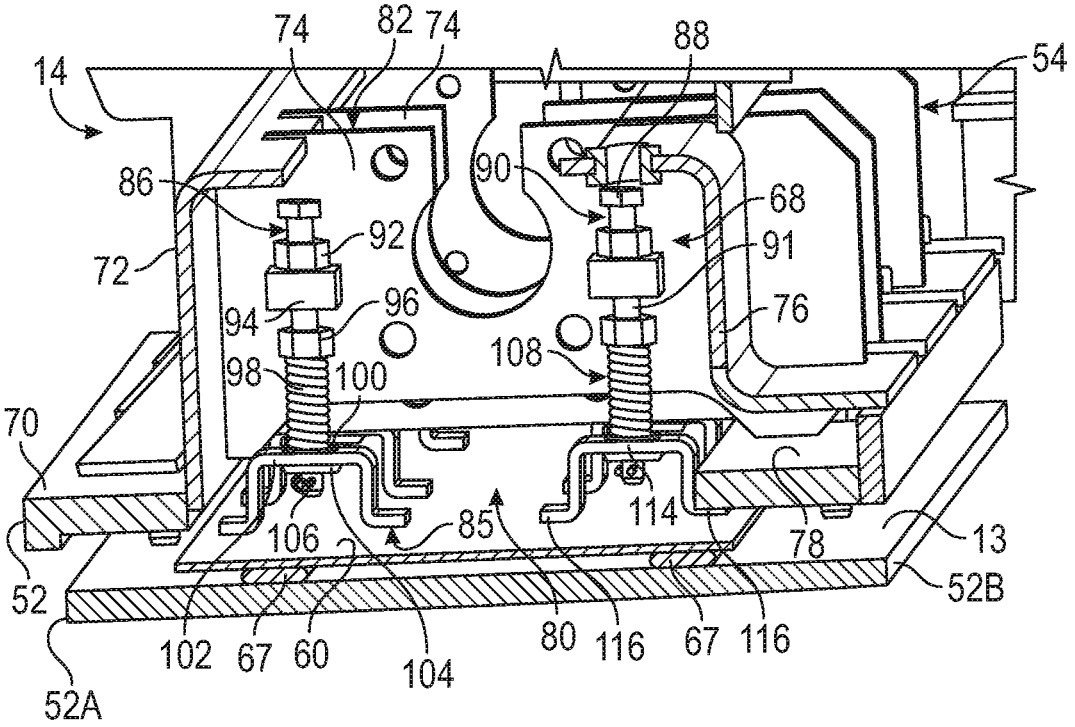
FIG. 4 is a second perspective view of the cross-section of the screed assembly of FIG. 2 showing several of the plurality of compression bolt assemblies according to an example of the present application.

FIGS. 3 and 4 show a cross-sectional view of the screed assembly 14 of FIG. 2 illustrating the screed plate 13, the screed frame 54 and the heating element cover 60, previously illustrated in FIG. 2. FIG. 4 further illustrates a portion of a heating element 67. The fasteners 55 (FIG. 2) are removed in FIGS. 3 and 4. FIG. 4 additionally shows a plurality of compression spring assemblies 68 according to an example of the present application. FIG. 3 shows one of the plurality of compression spring assemblies 68.

As shown in FIGS. 3 and 4, the screed frame 54 can include a trailing edge flange 70, a first raised middle portion 72, a plurality of cross-members 74, a second raised middle portion 76 and a leading edged flange 78.

As shown in FIGS. 3 and 4, the screed frame 54 can have an open shell construction with a space 80 defined by the first raised middle portion 72, the plurality of cross-members 74 and the second raised middle portion 76. The screed frame 54 can have a generally symmetrical shape with the construct of the trailing edge flange 70 and the first middle portion 72 being generally mirrored and opposed by the construct of the second raised middle portion 76 and the leading edge flange 78. Access to the space 80 can be via one or more openings 82 formed between the first raised middle portion 72 and the second raised middle portion 76. As will be discussed subsequently, the one or more openings 82 can provide access to the compression spring assemblies 68 and the space 80 can be sized and shaped to allow for adjustment of the compression spring assemblies 68 without removal of portions of the screed frame 54 and without fully decoupling the compression spring assemblies 68 from connection with the screed frame 54 or the heating element cover 60. More particularly, a head 88 of the bolt 86 (FIGS. 4 and 5) of the compression spring assemblies 68 is accessible through the one or more openings 82 of the screed frame 54 and resides within the space 80. The bolt 86 via the head 88 is engageable to move the bolt 86 to adjust the position of the heating element cover 60. This adjustment of position of the bolt 86 (and hence the heating element cover 60) can be done without changing a desired force exerted by a spring 98 of the compression spring assemblies 68 on the heating element cover 60. This adjustment of the heating element cover 60 by the bolt 86 can provide for a gap between the heating element cover 60 and the heating element 67 that can facilitate removal of the heating element 67 from between the heating element cover 60 and the screed plate 13.

The plurality of cross-members 74 can connect the first raised middle portion 72 with the second raised middle portion 76. The plurality of cross-members 74 can comprise thin plate-like structures and can be spaced apart from one another to provide the space 80.

The trailing edge flange 70 can comprise a thickened portion that can be connected to the first raised middle portion 72. The trailing edge flange 70 can have apertures 84 (FIG. 3) therein. These apertures 84 can receive the fasteners 55 of FIG. 2. The trailing edge flange 70 can be positioned at and form the trailing or rear side 52 of the screed assembly 14. As such, the trailing edge flange 70 can be positioned adjacent the trailing edge 52A of the screed plate 13.

Similarly, the leading edge flange 78 can be constructed in the manner of the trailing edge flange 70. Thus, the leading edge flange 78 can be connected to the second raised middle portion 76. The leading edge flange 78 can be configured to receive fasteners (not shown). The leading edge flange 78 can be positioned adjacent a leading edge 52B of the screed plate 13.

Figure 5:
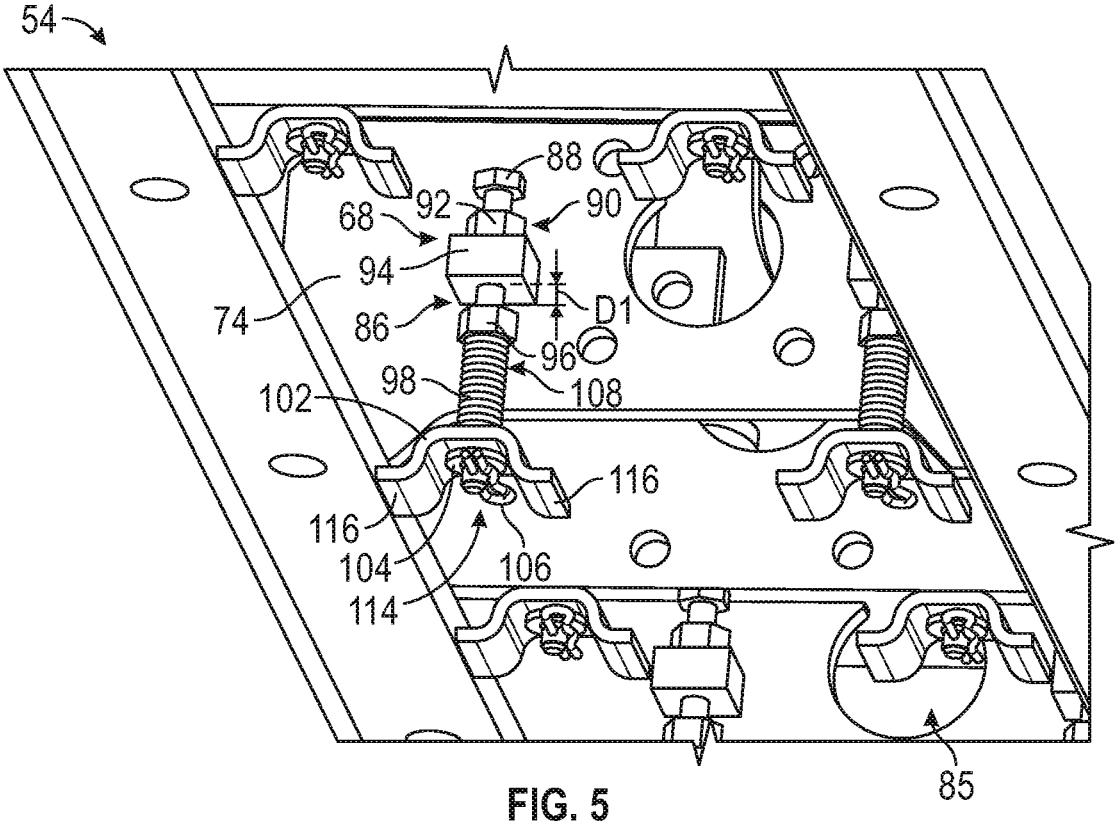
FIG. 5 is a perspective view of a bottom of the screed frame and showing several of the plurality of compression bolt assemblies with the screed plate, the heating assembly and the heating element cover are removed in FIG. 5 according to an example of the present application.

As shown in the embodiment of FIGS. 3-5, the compression spring assemblies 68 can connect at a proximal portion thereof to the screed frame 54, and in particular, the plurality of cross-members 74 and can connect at a distal portion thereof to the heating element cover 60.

Referring now specifically to FIGS. 4 and 5, each of the plurality of compression spring assemblies 68 can be organized in a plurality of rows 85 and each can include a bolt 86 with a head 88 at a proximal section 90 and a shaft 91. Each of the plurality of compression spring assemblies 68 can further include a welded nut 92, retaining element 94, a spring adjustment nut 96, a spring 98, a first washer 100 (FIG. 4), a saddle 102, a second washer 104 and a lock element 106.

The bolt 86 can be oriented with the shaft 91 extending generally transverse to a major surface of the heating element cover 60 (FIG. 4) such as the top thereof. The bolt 86 can have the proximal section 90 and a distal section 108. Parts of these sections 90, 108 of the shaft 91 of the bolt 86 can be threaded such as those portions that interact with the retaining element 94, spring adjustment nut 96 and/or welded nut 92.

As shown in FIG. 5, the retaining element 94 can comprise a block having a threaded aperture therethrough. This threaded aperture can receive the bolt 86 and can be configured to interact with threading on the shaft 91 of the bolt 86. The retaining element 94 can be connected to one of the plurality of cross-members 74 along at least one surface thereof (e.g., a side surface). Such connection can be via a weld, for example, although any other suitable mechanical mechanisms for connection (e.g., adhesive, fastener, male/female, rivet, solder/braze, etc.) are contemplated.

The welded nut 92 can be received on the bolt 86 at the shaft 91 proximal of the retaining element 94 adjacent the head 88. The welded nut 92 can be welded to the shaft 91 according to some examples. The welded nut 92 via abutting interaction with the retaining element 94 and/or head 88 can set a limit to the distal extent of the bolt 86 relative to the heating element cover 60 (FIG. 4).

Distal of the retaining element 94, the spring adjustment nut 96 can be threaded on the shaft 91 of the bolt 86. The spring adjustment nut 96 can be abutted by the spring 98 along a distal surface thereof. The spring 98 can be positioned around the shaft 91 of the bolt 86 and can extend to abut the first washer 100 (FIG. 4), or alternatively a proximal surface of the saddle 102.

In the operable position shown in FIG. 5, the spring 98 can comprise a compression spring and the spring adjustment nut 96 can be threadingly adjusted on the bolt 86 either proximal or distal to set a desired extent (and hence force applied by) for the spring 98. For example, if the spring adjustment nut 96 is moved distally relatively closer the saddle 102, the spring 98 applies a relatively larger desired force to the saddle 102 (via washer 100 if utilized), and hence the heating element cover (FIG. 4). The threaded interconnection of the bolt 86 and the spring adjustment nut 96 can allow for precise adjustment of the relative distance D1 (FIG. 5) of the spring adjustment nut 96 from the retaining element 94. In this manner, the desired force that results from the spring 98 can be precisely applied and controlled. This desired force can be set during OEM manufacture of the screed frame 54 with the plurality of compression spring assemblies 68.

The washer 100 can optionally be utilized and can be positioned to abut a proximal surface of the saddle 102. As discussed above, an opposing surface of the washer 100 can be abutted by the spring 98. As shown in FIG. 5, the saddle 102 can include a middle section 114 and feet 116. The feet 116 can connect to and extend distally from the middle section 114. The feet 116 can be configured to abut and connect with a proximal major surface of the heating element cover 60 (FIG. 4). Such connection can be via a weld, for example, although any other suitable mechanical mechanisms for connection (e.g., adhesive, fastener, male/female, rivet, solder/braze, etc.) are contemplated.

The design for the saddle 102 can facilitate access beneath the middle section 114, which is raised relative to the feet 116, for positioning and coupling of the second washer 104 (if utilized) and the lock element 106 distal of the saddle 102. The lock element 106 via the second washer 104 (if utilized) can connect and retain the saddle 102 to the bolt 86. The second washer 104 or the lock element 106 can be spaced from the distal surface of the middle section 114 a distance so as to facilitate movement of the bolt 86 in a proximal direction. In other cases the second washer 104 can abut the distal surface of the middle section 114. In either case, a proximal movement of the bolt 86 moves the saddle 102 proximally via the connection therebetween. As the saddle 102 is connected to the of the heating element cover 60, movement of the bolt 86 moves the saddle 102 and the heating element cover 60. In this manner, movement of the bolt 86 proximally (moving the head 88 further away from the retaining element 94) can raise the cover off the heating element to create the gap for removal of the heating element) is possible to create or increase the gap between the heating element and the heating element cover 60. Movement of the bolt 86 distally (moving the head 88 toward the retaining element 94) can lower the cover toward or onto the heating element to decrease or eliminate the gap for capturing/covering the heating element) is possible to decrease or eliminate the gap between the heating element and the heating element cover 60.

As shown in the example of FIG. 5, the middle section 114 has an aperture therein that is configured to receive the distal section 108 of the bolt 86. The distal section 108 passes therethrough and protrudes distal of the middle section 114 but terminates at the tip prior to reaching a distal extent equivalent to that of the feet 116. The distal section 108 can additionally be received by and pass through the second washer 104. The distal section 108 near the tip of the bolt 86 can have an aperture therein which can extend substantially transverse to a longitudinal axis of the shaft 91 of the bolt 86. This aperture can receive a portion of the lock element 106 therein. Although shown as a cotter key in the example of FIG. 5, the lock element 106 can be another suitable mechanical feature such as another nut, for example.

INDUSTRIAL APPLICABILITY

Example machines in accordance with this disclosure can be used in a variety of industrial, construction, commercial or other applications including paving. Such machines can have one or more screed assemblies 12 including one or more screed plates 13 and corresponding heating element covers 60 that are configured to protect the heating element 67 located between the screed plate 3 and the heating element cover 60 from loose debris.

The screed assembly 12 design, in particular with one or more openings 82, space 80 and the plurality of compression spring assemblies 68 can reduce the time and complexity associated with repair or replacement of the heating element 67. These items can also increase repeatability of loading/spacing the heating element cover 60 to OEM specifications.

According to one example, the plurality of compression spring assemblies 68 can be assembled as an OEM component to provide a known desired hold down force on the heating element cover 60 (FIG. 4). This hold down force does and/or position of the spring 98 and the spring adjustment nut 96 need not be altered from the OEM setting for removal of the heating element 67. Rather, the plurality of compression spring assemblies 68 are designed to facilitate ease of removal of the heating element 67 for repair or replacement and insertion of a new or repaired heating element 67 by simply engaging the head 88 of the bolt 86 and adjusting the position of the bolt 86. The plurality of compression spring assemblies 68 are also designed so that the desired hold down force applied by the assemblies 68 on the heating element cover 60 does not change. Further, the desired gap between the heating element 67 and the heating element cover 60 can easily and accurately be replicated by personnel upon replacement of the heating element 67. This can be done simply be threadingly re-positioning the bolt 86 back to the OEM position.

In some examples it is desirable to have no desired gap between the heating element cover 60 and the heating element 67. In such situation, an interference resulting in a clamping force can applied by the heating element cover 60 to the heating element 67. After initial OEM assembly, if it is desired to remove the heating element 67 from between the heating element cover 60 and the screed plate 13 (or simply have a small gap therefrom so no clamping force is applied), this can simply be accomplished by adjusting the position of the bolt 86 as described previously.

Furthermore, the present design of the screed assembly 12 with the plurality of compression spring assemblies 68 each having a same or similar length and applied force can promote a more uniform position of the heating element cover 60, which can lead to a more even heat transfer distribution.

Typical screed assemblies such as those of such as those of U.S. Pat. No. 10,017,905 are not configured to provide for ease of removal of the heating element, ease of installation of the heating element, ease of access for removal or installation, easily repeatable positioning of the heating element cover relative to the heating element in the manner of the embodiment discussed above.

The above detailed description is intended to be illustrative, and not restrictive. The scope of the disclosure should, therefore, be determined with references to the appended claims, along with the full scope of equivalents to which such claims are entitled. The claims should be considered part of the specification for support purposes.

What is claimed is:

1. A screed assembly for use with a paving machine, comprising:

a screed plate;

a heating assembly having a heating element;

a heating element cover;

a screed frame releasably coupled to the screed plate and having one or more openings therein, the screed frame has a symmetric shape including opposing raised middle sections that are spaced apart to form the one or more openings, positioned within the one or more openings are the heating element cover positioned on or adjacent the heating element with the heating element positioned on the screed; and a plurality of compression spring assemblies connected to the screed frame and connected to the heating element cover, wherein each of the plurality of compression spring assemblies includes at least a bolt, a spring and a spring adjustment nut that together are configured to exert a desired force on the heating element cover, wherein the plurality of compression spring assemblies are accessible through the one or more openings of the screed frame and the bolt is moveable relative to the screed frame to adjust a position of the heating element cover relative to the heating element for facilitating removal of the heating element.

2. The screed assembly of claim 1, wherein each of the plurality of compression spring assemblies further comprises:

a retaining element having a threaded aperture therein configured to receive a proximal portion of the bolt, wherein the retaining element is connected to the screed frame;

a saddle having an aperture therein configured to receive a distal portion of the bolt and connected to the heating element cover with feet at a top surface thereof; and a lock element coupled to the distal portion of the bolt that protrudes distally from the saddle.

3. The screed assembly of claim 2, wherein each of the plurality of compression spring assemblies further includes a welded nut positioned between the retaining element and a head of the bolt.

4. The screed assembly of claim 3, wherein the lock element comprises a cotter key that couples to the bolt at the distal portion.

5. The screed assembly of claim 1, wherein the screed frame a plurality of trailing edge flanges positioned on a trailing side of the one of the middle sections and a plurality of leading edge flanges positioned on a leading side of the second of middle sections.

6. The screed assembly of claim 5, wherein the raised middle sections are connected by a plurality of cross-members extending therebetween, and wherein the plurality of compression spring assemblies are connected to the screed frame at the plurality of cross-members.

7. The screed assembly of claim 5, wherein the plurality of compression spring assemblies are spaced from one another in a plurality of rows, wherein the bolt of each of the plurality of compression spring assemblies are position adjustable to increase a gap between the heating element cover and the heating element thereby allowing for removal of the heating element from between the screed plate and the heating element cover, and wherein the bolt of each of the plurality of compression spring assemblies are position adjustable to decrease or eliminate the gap thereby retaining the heating element between the screed plate and the heating element cover.

8. The screed assembly of claim 7, wherein the desired force on the heating element cover by the plurality of compression spring assemblies remains the same during the increase of the gap or the decrease of the gap.

9. The screed assembly of claim 1, wherein a relative position of the spring adjustment nut and the spring remains the same as the bolt is moved relative to the screed frame to adjust the position of the heating element cover relative to the heating element.

10. A paving system for laying an asphalt paving material, comprising:

a paving machine; and a screed assembly configured to be removably connected to the paving machine, the screed assembly comprising:

a screed plate;

a heating element cover;

a heating assembly including a heating element insertable between the screed plate and the heating element cover;

a screed frame configured to be spaced from the screed plate and removably coupled thereto, wherein the screed frame includes one or more openings therein, the screed frame has a symmetric shape including opposing raised middle sections that are spaced apart to form the one or more openings, positioned within the one or more openings are the heating element cover positioned on or adjacent the heating element with the heating element positioned on the screed; and a plurality of compression spring assemblies configured to be connected to the screed frame and configured to be connected to the heating element cover, wherein the plurality of compression spring assemblies are configured to set a desired position between the heating element cover and the heating element, and wherein the plurality of compression spring assemblies reside in a space in the screed frame and are accessible through the one or more openings of the screed frame to adjust the desired position.

11. The paving system of claim 10, wherein each of the plurality of compression spring assemblies comprises:

a bolt;

a spring; and a spring adjustment nut that together are configured to exert a desired force on the heating element cover, wherein at least the bolt is accessible through the one or more openings of the screed frame and is moveable to adjust a gap between the heating element cover and the heating element, and wherein a relative position of the spring adjustment nut and the spring remains the same as the bolt is moved relative to the screed frame to adjust the position of the heating element cover relative to the heating element.

12. The paving system of claim 11, wherein each of the plurality of compression spring assemblies further comprises:

a retaining element having a threaded aperture therein configured to receive a proximal portion of the bolt, wherein the retaining element is connected to the screed frame;

a saddle having an aperture therein configured to receive a distal portion of the bolt and having feet connected to the heating element cover at a top surface thereof; and a lock element coupled to the distal portion of the bolt that protrudes distally from the saddle.

13. The paving system of claim 12, wherein each of the plurality of compression spring assemblies further includes a welded nut positioned between the retaining element and a head of the bolt.

14. The paving system of claim 12, wherein the lock element comprises a cotter key that couples to the bolt at the distal portion.

15. The paving system of claim 10, wherein the raised middle sections are connected by a plurality of cross-members extending therebetween, and wherein the plurality of compression spring assemblies are connected to the screed frame at the plurality of cross-members.

16. The paving system of claim 10, wherein the plurality of compression spring assemblies are spaced from one another in a plurality of rows, wherein the plurality of compression spring assemblies are position adjustable to increase a gap between the heating element cover and the heating element thereby allowing for removal of the heating element from between the screed plate and the heating element cover, and wherein the plurality of compression spring assemblies are position adjustable to decrease or eliminate the gap thereby retaining the heating element between the screed plate and the heating element cover.

* * * * *